US006763567B2

(12) United States Patent
Smith et al.

(10) Patent No.: US 6,763,567 B2
(45) Date of Patent: Jul. 20, 2004

(54) PALLET ASSEMBLY DEVICE AND METHOD OF ASSEMBLING PALLETS

(75) Inventors: Dustin W. Smith, Carthage, MO (US); Dale De'Crescenzo, Carthage, MO (US)

(73) Assignee: Fastening Technologies, LLC, Carthage, MO (US)

( * ) Notice: Subject to any disclaimer, the term of this patent is extended or adjusted under 35 U.S.C. 154(b) by 40 days.

(21) Appl. No.: 10/144,959

(22) Filed: May 14, 2002

(65) Prior Publication Data

US 2003/0213116 A1 Nov. 20, 2003

(51) Int. Cl.[7] ..... B21D 19/00

(52) U.S. Cl. ..... 29/430; 29/772; 29/429; 29/428; 29/783; 29/525; 29/714; 227/2; 227/4

(58) Field of Search ..... 29/430, 428, 429, 29/525, 525.01, 772, 783, 787, 789, 798, 701, 714, 716, 791, 795, 709, 711; 227/2, 3, 4, 5, 6

(56) References Cited

U.S. PATENT DOCUMENTS

| | | | | |
|---|---|---|---|---|
| 3,755,871 A | | 9/1973 | Nelson, Jr. | 29/200 |
| 3,945,549 A | | 3/1976 | Colson | 227/45 |
| 3,982,313 A | | 9/1976 | Nelson, Jr. | 29/432 |
| 4,392,600 A | * | 7/1983 | Billett et al. | 227/50 |
| 4,403,388 A | | 9/1983 | Belcher | 29/429 |
| 4,489,874 A | * | 12/1984 | Worst et al. | 227/7 |
| 4,492,016 A | * | 1/1985 | Smets et al. | 29/432 |
| 4,793,540 A | | 12/1988 | Mangan | 227/7 |
| 4,824,004 A | * | 4/1989 | Hanson | 227/152 |
| 5,249,352 A | | 10/1993 | Landers | 29/432 |
| 5,355,575 A | | 10/1994 | Self | 29/430 |
| 5,379,513 A | | 1/1995 | Thompson | 29/772 |
| 5,547,002 A | * | 8/1996 | Runnebaum | 144/332 |
| 5,943,766 A | * | 8/1999 | Beane | 29/772 |
| 6,176,009 B1 | | 1/2001 | Inman | 29/772 |

FOREIGN PATENT DOCUMENTS

| | | | |
|---|---|---|---|
| EP | 0 512 970 A1 | 11/1992 | B27M/3/00 |
| ES | 2 207 487 | 6/1992 | B27F/7/02 |
| FR | 2 418 704 | 9/1979 | B27M/3/34 |
| FR | 2 672 001 | 7/1992 | B27M/3/34 |
| FR | 2 814 733 | 4/2002 | B65H/59/38 |

OTHER PUBLICATIONS www.vikingeng.com; Apr. 18, 2002.
www.smcllc.com; Apr. 17, 2002.
"Viking" pamphlet.
International Search Report dated Jul. 30, 2003, PCT/US03/14837.

* cited by examiner

*Primary Examiner*—David P. Bryant
*Assistant Examiner*—Stephen Kenny
(74) *Attorney, Agent, or Firm*—H. Frederick Rusche, Esq.; Grant D. Esq.; Husch & Eppenberger, LLC

(57) ABSTRACT

A pallet assembly device is disclosed that is configured to automatically position pallet components together and to automatically secure such components to each other. Furthermore, the pallet assembly device of the invention is preferably fed stacks of pallet components, and thereby eliminates the need for an assembly operator to manually position various pallet components in a jig or carriage. Yet further, the device preferably comprises a plurality of wheels that are positioned to simultaneously engage opposite sides of a pallet component and comprises a drive motor. The drive motor is preferably operatively connected to at least one of the plurality of wheels in a manner allowing the drive motor to rotationally drive and rotationally stop at least one of the plurality of wheels so as to move the component along an assembly path. A method of assembling pallet components using a pallet assembly device is also disclosed.

20 Claims, 9 Drawing Sheets

PALLET ASSEMBLY DEVICE AND METHOD OF ASSEMBLING PALLETS

BACKGROUND OF THE INVENTION (1) Field of the Invention

This invention relates generally to the field of pallet assembly devices and methods of assembling pallets. More particularly, the invention pertains to an automated pallet assembly apparatus for producing block-style pallets that is configured to automatically attach three blocks to an individual slat in a manner to form a stringer of a block-style pallet. The apparatus is configured to automatically repeat the procedure utilizing blocks and slats automatically retrieved from stacks of blocks and slats held in dispensing stations of the apparatus. The assembly apparatus provides an economical method for rapidly fabricating block-style pallet stringers.

(2) Related Art

Numerous automated devices have been developed to facilitate the assembly of pallets. These devices include relatively inexpensive devices that perform only small subportion of pallet assembly and also include large scale pallet assembly devices that are capable of automatically producing several hundred pallets per hour.

Despite the many developments made in industry for assembling pallets, the are many disadvantages associated with various types of prior art automated pallet assembly devices. One obvious such disadvantage is the cost of such assembly devices, which can make large automated assembly devices uneconomical for production facilities that do not have the demand for operating such devices continually. Other less complex and less expensive assembly devices require slats, stringers, blocks, or other pallet components to be manually positioned in their relative assembled positions or within jigs or carriages. Such manual positioning tends to increase labor costs and/or slow production rates. At least some relatively small scale assembly devices, such as the device disclosed in U.S. Pat. No. 4,403,388, automatically position at least some pallet components in their assembled position prior to assembling such components. However, such devices, despite being relatively small in scale, often have numerous moving parts that are subject to wearing and/or require frequent maintenance.

SUMMARY OF THE INVENTION

It is in view of the above problems that the present invention was developed. The present invention overcomes many of the disadvantages associated with prior art pallet assembly devices by providing a pallet assembly device for, and method of, automatically positioning various pallet components, as well as automatically attaching such components together, without requiring numerous moving parts.

One aspect of the invention generally pertains to pallet assembly device that preferably comprises a slat dispensing station, a block dispensing station, a clamping station, a slat conveying mechanism, a block conveying mechanism, and an automatic fastening device. The slat dispensing station is configured and adapted to hold a plurality of pallet slats stacked vertically one above another. Likewise, the block dispensing station is configured and adapted to hold a plurality of pallet blocks stacked vertically one above another. The clamping station is configured and adapted to bias a block into engagement with a slat. The slat conveying mechanism operatively connects the slat dispensing station to the clamping station and is configured and adapted to repetitively engage and separate a lower most slat from a plurality of slats positioned in the slat dispensing station and to transfer such a slat to the clamping station. The slat conveying mechanism is further configured and adapted to position that slat at first, second, and third distinct stopped positions relative to the clamping station. The block conveying mechanism is configured and adapted to repetitively engage and separate a lower most block from a plurality of blocks positioned in the block dispensing station and to transfer that block to the clamping station. The block conveying mechanism is further configured and adapted to position blocks above the slat when the slat is stopped in any one of the first, second, and third distinct stopped positions. The automatic fastening device is configured and adapted to force a fastener upwardly through the slat and into a block when the slat and has been stopped in any one of the first, second, and third positions and such a block is being bias into engagement with the slat.

Another aspect of the invention generally pertains to pallet assembly device that preferably comprises a component dispensing station, a clamping station, and a component conveying mechanism. The component dispensing station is configured and adapted to hold a plurality of pallet components and the clamping station is configured and adapted to bias pallet components together. The component conveying mechanism operatively connects the component dispensing station to the clamping station and comprises a plurality of wheels that are mounted to the assembly device for rotation about separate axes. The wheels are positioned to simultaneously engage opposite sides of a pallet component when such a component is being transferred by the component conveying mechanism to the clamping station. The component conveying mechanism also comprises a drive motor that is operatively connected to at least one of the plurality of wheels in a manner allowing the drive motor to rotationally drive and rotationally stop at least one of the plurality of wheels to thereby adjust the position of a pallet component relative to the clamping station.

Yet another aspect of the invention pertains to a method of assembling a pallet that preferably comprises the step of providing an automated pallet assembly apparatus having an assembly path, a slat dispensing station, and a block dispensing station, with the assembly path operatively connecting the slat dispensing station to the block dispensing station. The method further preferably comprises providing a plurality of slats to the slat dispensing station and providing a plurality of blocks to the block dispensing station.

The method also preferably comprises utilizing the assembly apparatus to automatically move a first one of the plurality of slats longitudinally along the assembly path from the slat dispensing station toward the block dispensing station and to automatically stop the movement of the first slat at a first position along the assembly path. In the first position, a first longitudinal end of the first slat is positioned adjacent the block dispensing station along the assembly path. The method yet further preferably comprises automatically biasing a first block of the plurality of blocks into engagement with the first slat, when it is stopped in the first position, and automatically fastening the first slat to the first block while the first slat and the first block are being biased into engagement with each other.

Still further, the method preferably comprises utilizing the assembly apparatus to automatically longitudinally move the first slat from the first position and to automatically stop the movement of the first slat at a second position along the assembly path. The second position is further along the assembly path from the slat dispensing station than the first position and the method preferably further comprises automatically biasing a second block into engagement with the first slat, when it is in the second position, and automatically fastening the first slat to the second block while the first slat and the second block are being biased into engagement with each other.

Yet further, the method preferably comprises utilizing the assembly apparatus to automatically longitudinally move the first slat from the second position and to automatically stop the movement of the first slat at a third position along the assembly path. In the third position, the longitudinal end of the slat opposite its first longitudinal end is positioned adjacent the block dispensing station along the assembly path. Finally, the method yet further preferably comprises automatically biasing a third block into engagement with the first slat, when it is in the third position, and automatically fastening the first slat to the third block while the first slat and the third block are being biased into engagement with each other.

Further features and advantages of the present invention, as well as the structure and operation of an embodiment of the present invention, are described in detail below with reference to the accompanying drawings.

BRIEF DESCRIPTION OF THE DRAWINGS

The accompanying drawings, which are incorporated in and form a part of the specification, illustrate the preferred embodiment of the present invention and together with the description, serve to explain the principles of the invention. In the drawings.

Reference characters in the written description of the specification indicate corresponding parts throughout the several views of the drawings.

DETAILED DESCRIPTION OF THE PREFERRED EMBODIMENT

Figure 1:
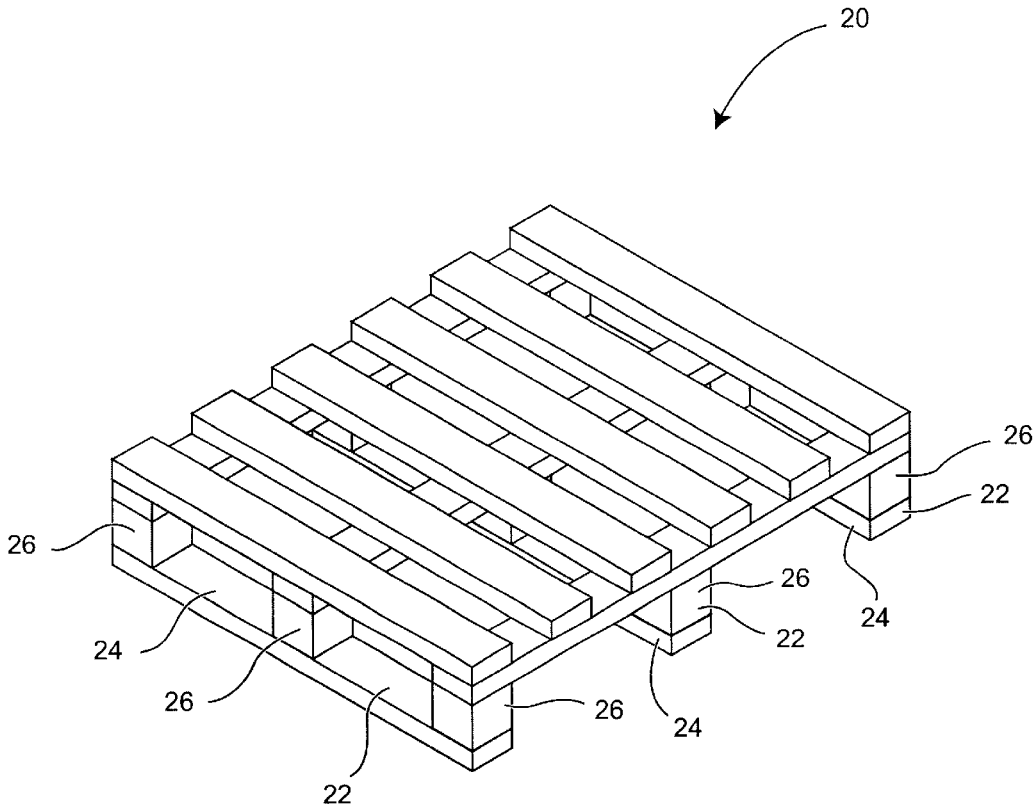
FIG. 1 is an isometric view of a standard block-style pallet.
Figure 2:
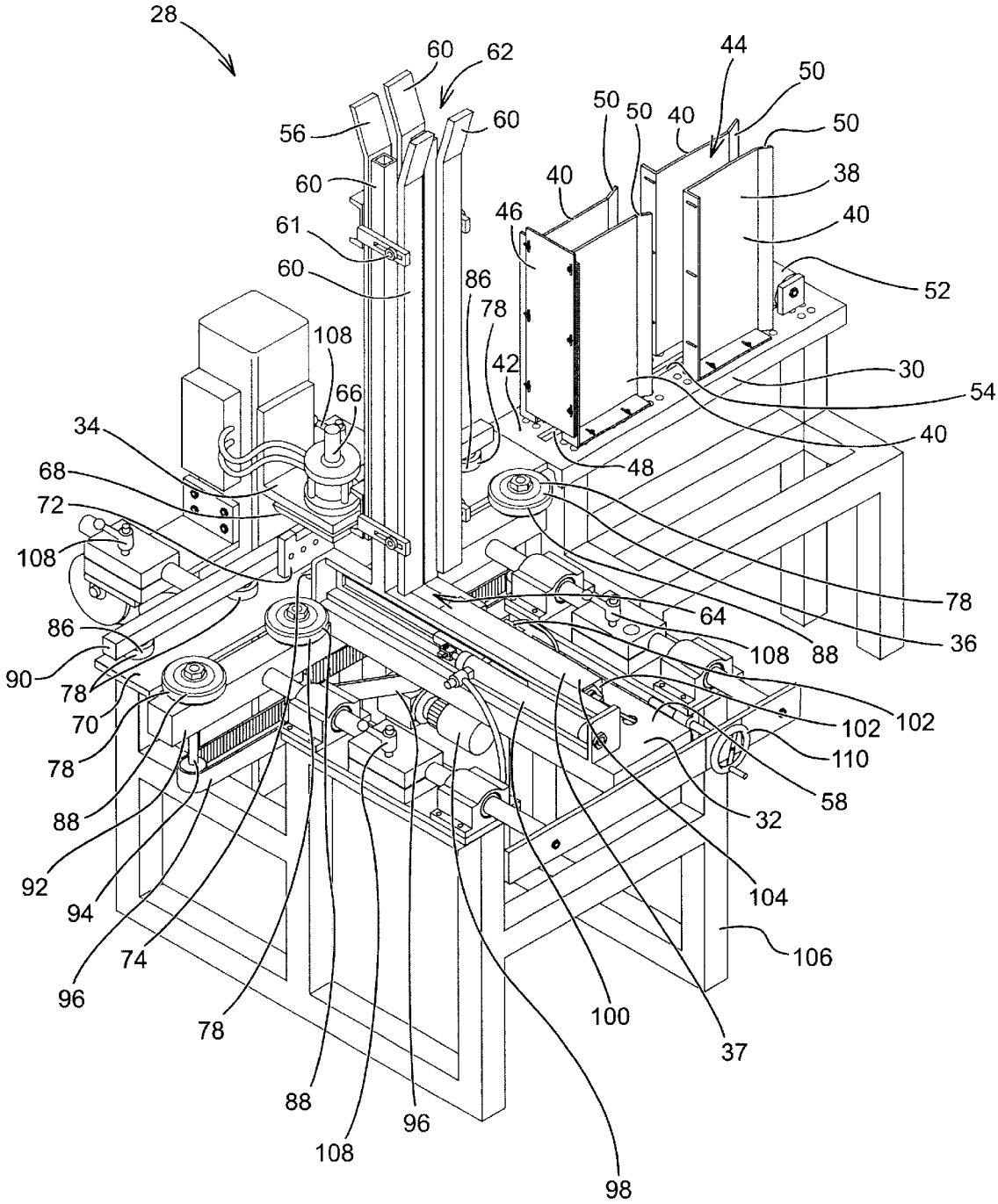
FIG. 2 illustrates an isometric view of the preferred embodiment of a pallet assembly device in accordance with the invention.

The pallet assembly device of the preferred embodiment of the invention is specifically configured and adapted to assemble portions of a standard block-style pallet 20 of the type shown in FIG. 1. In particular, the pallet assembly device of the preferred embodiment is configured and adapted to assemble the stingers 22 of block-style pallets 20, which themselves each comprise a single slat 24 with a block 26 attached at each longitudinal end thereof and another block positioned centrally therebetween.

In general, the pallet assembly device 28 of the preferred embodiment is shown in FIGS. 2–9 and comprises a slat dispensing station 30, a block dispensing station 32, and a clamping station 34. The pallet assembly device 28 further includes a slat conveying mechanism 36 and a block conveying mechanism 37. The slat conveying mechanism 36 is configured to move slats longitudinally from the slat dispensing station 30 through the clamping station 34, thereby defining an assembly path along which such slats travel. The block conveying mechanism 37 is configured to move blocks from the block dispensing station 32 to the clamping station 34.

The slat dispensing station 30 of the pallet assembly device 28 of the preferred embodiment generally comprises a receiving bin 38 that is formed of a plurality of opposed vertical side wall members 40 that are mounted to a horizontal surface 42. The side wall members 40 are spaced apart from each other such that a slot 44 is formed that has a width slightly larger than the width of the slats 24 being used to form the stingers 22 of the block-style pallets 20. A vertical end wall 46 is preferably mounted to a pair of the side wall members 40 in a manner such that it substantially closes the slot 44 at one end. However, the end wall 46 is mounted to the side wall members 40 in a manner such that it is spaced above the horizontal surface 42 by a distance greater than the thickness of each of the slats 24 but less than twice such thickness. The opposite ends 50 of the side wall members 40 remain open and are preferably flared apart. The pair of side wall members 40 and the end wall 46 are preferably secured to each other and to the horizontal surface 42 using bolts passed through slotted holes so as to allow the width of the slot 44 and the height of the opening 48 to be adjusted to accommodate various alternative sizes of slats 24. A roll pin 52 is preferably mounted to the horizontal surface 42 adjacent the open end of the slot 44. Finally, an elongated slot 54 extends through the horizontal surface 42 along the length of the slot 44 of the receiving bin 38 to accommodate a portion of the slat conveying mechanism 36 of the pallet assembly device 28, as described below.

The block dispensing station 32 of the pallet assembly device 28 of the preferred embodiment comprises a block holder member 56 that extends vertically from a horizontal block holder surface 58. The block holder member 56 preferably comprises a plurality of bar members 60 that are spaced from each other to form a slot 62 that is dimensioned to receive and hold a plurality of stacked blocks 26 of the type used to form the block-style pallets 20. Adjustment knobs 61 are provided to allow the space between the bar members 60 to be adjusted to accommodate different sizes of blocks 26. The bar members 56 are spaced above from the horizontal block holder surface 58 by a distance larger than the height of a block 26, but less than the height of two blocks, in a manner such that an opening 64 is formed at the base of the block holder. The opening allows a lower most block 26 resting on the horizontal block holder surface 58 to pass horizontally out of the slot 62 of block holder 56 via the block conveying mechanism 37 as is described below.

The clamping station 34 of the pallet assembly device 28 of the preferred embodiment comprises a fluid cylinder 66 supporting an upper horizontal plate 68 that opposes a lower base plate 70 therebeneath. A vertically oriented side plate 72 is positioned adjacent one side of the upper horizontal plate 68 and extends between the upper horizontal plate and the lower base plate 70. The clamping station 34 further comprises an automatic fastening device (not shown) positioned beneath the lower base plate 70. A fastener slot 74 extends through the base plate 70 and is aligned with the automatic fastening device. The fluid cylinder 66 is configured to raise and lower the upper horizontal plate 68 relative to the lower base plate 70. The automatic fastening device is preferably mechanical stapler of the type that cuts and forms staples from an arbitrary length of wire, such as from a spool of wire. The automatic fastening device is configured and adapted to drive such staples upwardly through the fastener slot 74 of the lower base plate 70.

Figure 3:
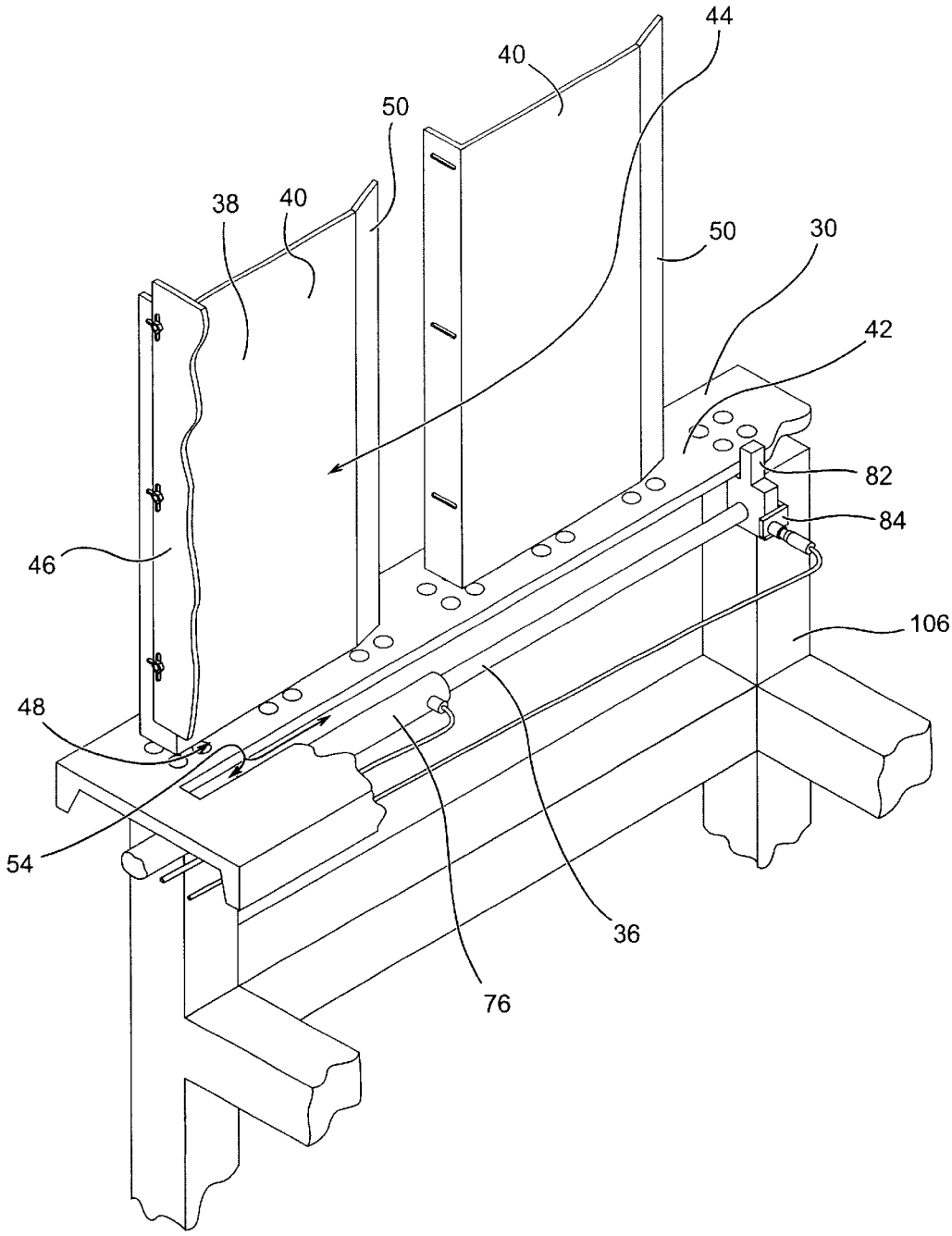
FIG. 3 illustrates a partial detail view of the slat dispensing station and a portion of the slat conveying mechanism of the pallet assembly device of FIG. 2, shown with portions thereof removed for clarity.
Figure 4:
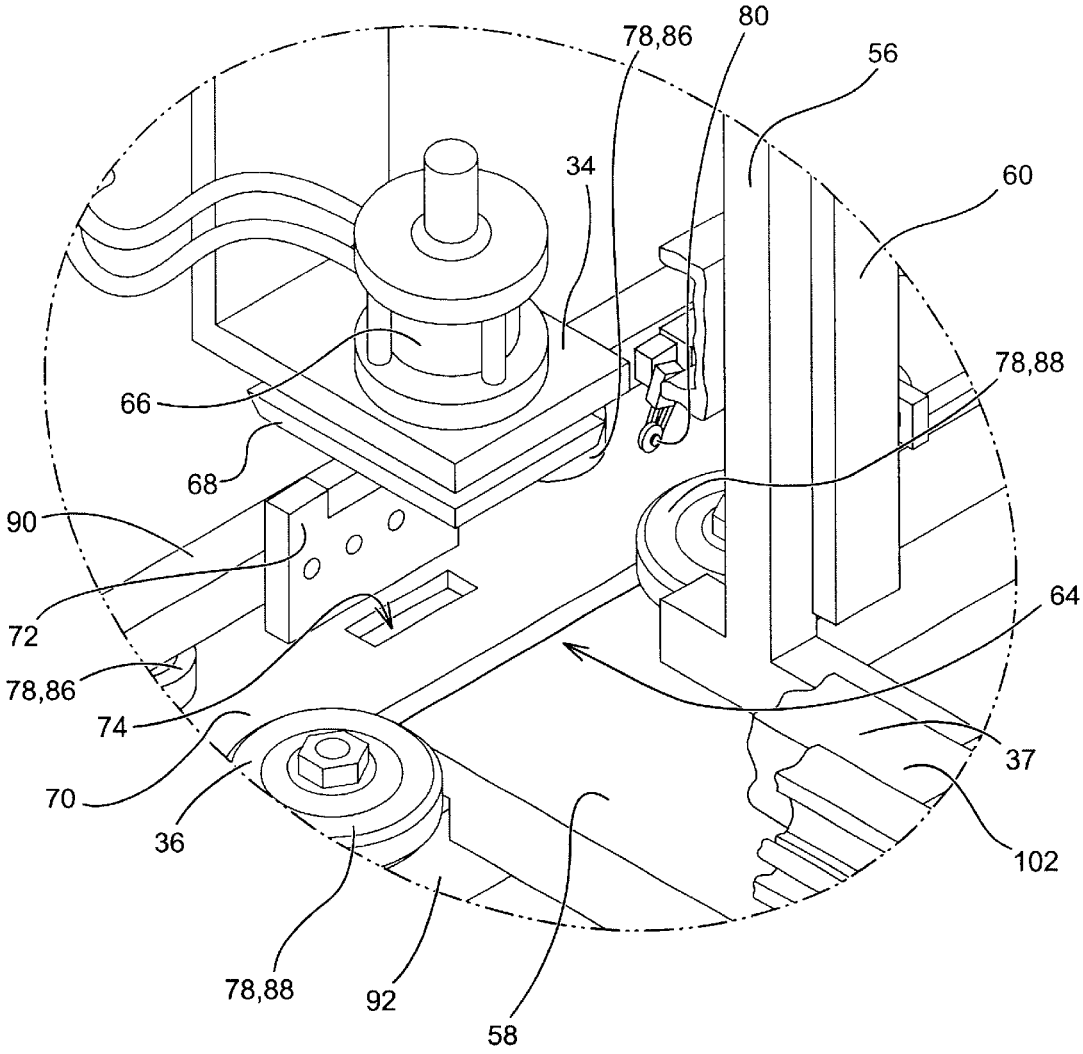
FIG. 4 illustrates a partial detail view of the pallet assembly device of FIG. 2, focusing on the clamping station and the block dispensing station with portions of the block dispensing station removed for clarity.
Figure 5:
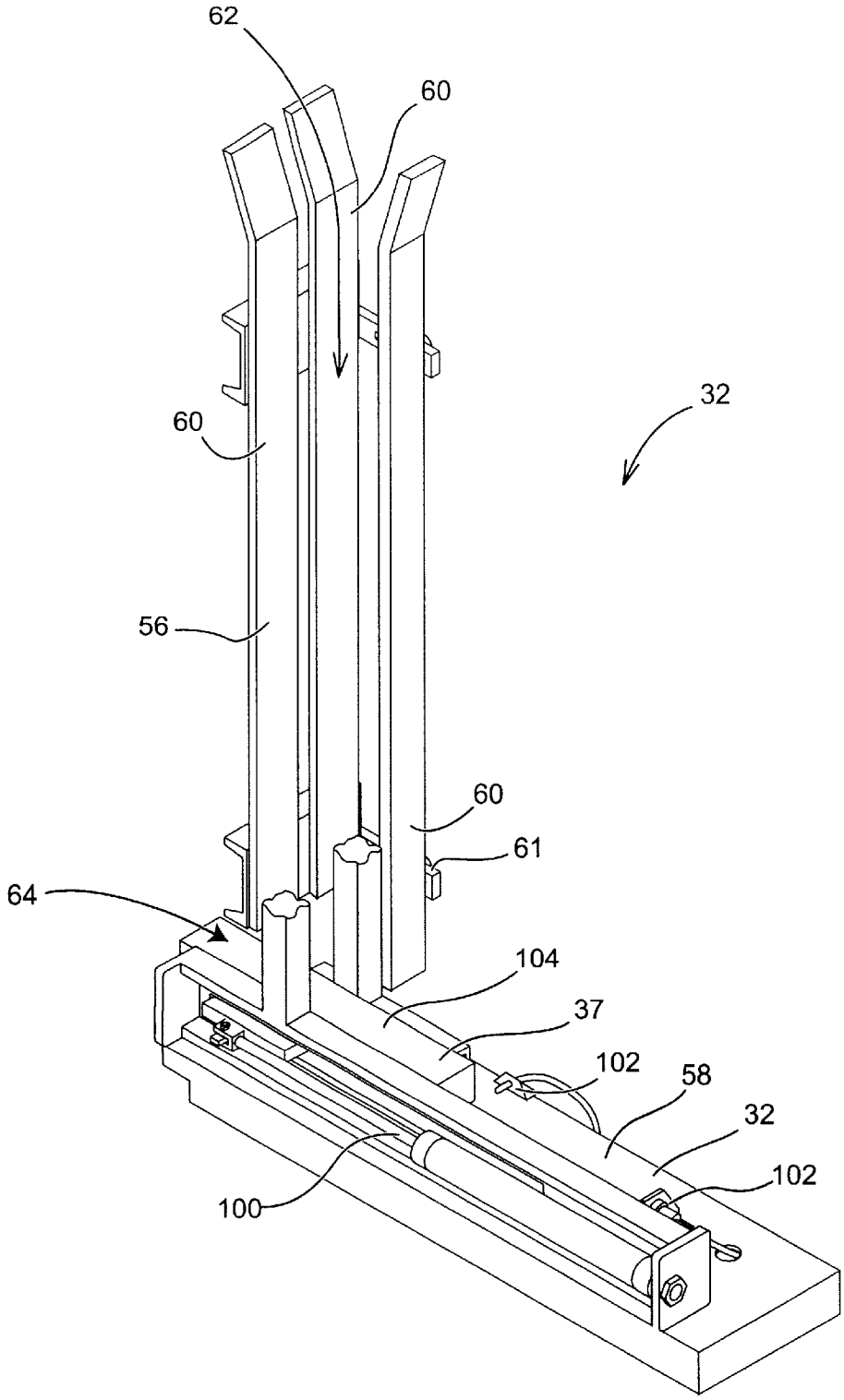
FIG. 5 illustrates a partial detail view of the block dispensing station of the pallet assembly device of FIG. 2, shown with portions thereof removed for clarity.
Figure 6:
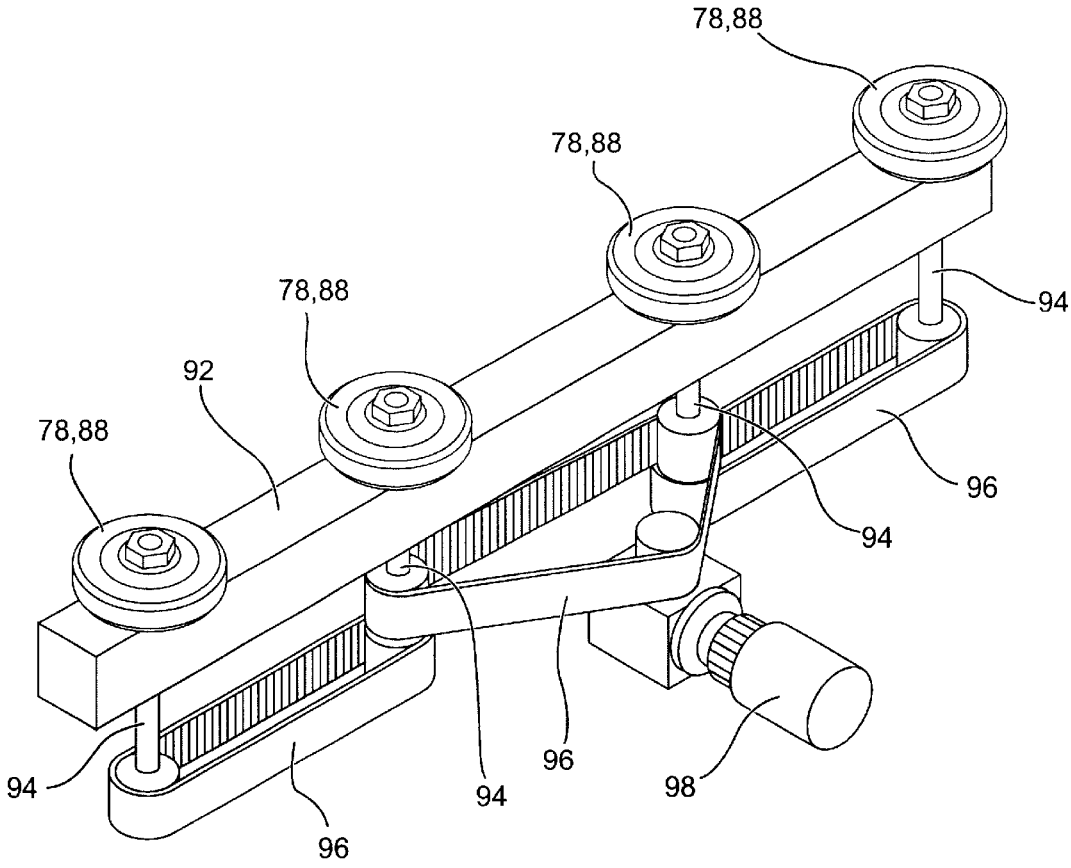
FIG. 6 illustrates a view of the drive wheels assembly of the pallet assembly device of FIG. 2, shown with the block dispensing station removed therefrom for clarity.

The slat conveying mechanism 36 of the pallet assembly device 28 of the preferred embodiment includes portions of the slat dispensing station 30 and the clamping station 34. In particular, the horizontal surface 42 of the slat dispensing station 30 and the lower base plate 70 and side plate 72 of the clamping station 34 act as bearing surfaces along which slats 24 travel when being conveyed by the slat conveying mechanism 36. The slat conveying mechanism 36 also comprises, among other things, a cylinder 76, two parallel rows of guide wheels 78, and a slat position sensor 80. As seen in FIG. 3, the cylinder 76 of the slat conveying mechanism 36 is positioned beneath the horizontal surface 42 of the slat dispensing station 30. The cylinder 76 is connected to a tooth member 82 that extends upwardly through the elongated slot 54 of the horizontal surface 42 and slightly into the slot 44 of the receiving bin 38 and is configured to selectively move the tooth member back and forth horizontally along the elongated slot. One or more sensors 84 may also be provided to identify when the tooth member reaches limit positions relative to the elongated slot 54, so as to prevent damage to the components of the pallet assembly device 28 and to reverse the direction of the cylinder's 76 operation.

The wheels 78 of the slat conveying mechanism 36 form a row of idler wheels 86 and a row of drive wheels 88. The row of idler wheels 86 is parallel to the row of drive wheels 88 and the rows are positioned horizontally spaced apart from each other immediately above the lower base plate 70 of the clamping station 34, on opposite sides of the fastener slot 74. The idler wheels 86 are each suspended from a first beam 90 and are configured to freely rotate about separate vertical axes. The drive wheels 88 are mounted above a second beam 92 and a configured to rotate with separate vertical axles that are link together to rotate in unison via a plurality of drive belts 96. The drive belts 96 are linked to a electric motor 98. The slat position sensor 80 is positioned between the idler wheels 86 and the drive wheels 88 immediately above the lower base plate 70 of the clamping station 34 where it will detect a slat 24 passing over the lower base plate.

The block conveying mechanism 37 of the pallet assembly device 28 of the preferred embodiment comprises another cylinder 100 and a plurality of sensors 102. Like the other cylinders, the cylinder 100 of the block conveying mechanism is preferably pneumatic. The piston is connected to the block dispensing station 32 and is configured and adapted to move a pushing ram 104 horizontally back and forth over the block holder surface 58. As the pushing ram 104 moves in response to the piston 100, the pushing ram 104 passes back and forth beneath the bar members 60 of the block holder through the opening 64 at the base thereof. The sensors 102 are mounted where they can identify the position of the pushing ram 104, so as to limit the travel of the cylinder 100, thereby preventing damage to the pallet assembly device 28 by stopping or reversing the direction of the cylinder's operation.

In addition to the components discussed above, the pallet assembly device 28 also comprises various other elements such as a base frame 106 formed of welded square tubing and an electronic control unit (not shown) for controlling the operation of the various above-mentioned components. The base frame 106 supports and physically connects the various stations of the pallet assembly device 28 and comprises several adjustment clamps 108. The base frame 106 generally holds the slat dispensing station 30 in a fixed orientation relative to the clamping station 34 and in a manner such that the horizontal surface 42 of the slat dispensing station is coplanar with the lower base plate 70 of the clamping station. The side plate 72 of the clamping station 34 is supported by the first beam 90 of the slat conveying mechanism 36, which is mounted to the base frame 106 in a manner such that the first beam, along with the side plate and the idler wheels 86 of the slat conveying mechanism, can be horizontally repositioned relative to the lower base plate 70 of the clamping station. At least one of the clamps 108 of the base frame 106 is configured to lock the first beam 90 of the slat conveying mechanism 36 in a given position. The block dispensing station 32, the block conveying mechanism 37, and the second beam 92, drive wheels 88, drive belts 96, and electric motor 98 of the slat conveying mechanism 36 are all preferably fixed in position relative to each other as a unit but are also horizontally adjustable relative to the base frame 106. A hand operated crank 110 facilitates such adjustments and the unit can be locked in a particular position via use of the adjustment clamps 108.

The electronic control unit of the pallet assembly device 28 is operatively connected to the slat conveying mechanism 36, the block conveying mechanism 37, and the clamping station 34. The control unit is configured to activate the various cylinders 66,76,100, the electric motor 98, and the automatic fastening device in response to signals from the slat position sensor 80.

Prior to operation, the pallet assembly device 28 of the preferred embodiment can first be adjusted to accommodate the specific dimensions of the slats 24 and blocks 26 being used to form the stringers 22 of the particular block-style pallet 20 being assembled. This is done by adjusting the side wall members 40 and the end wall 46 of the receiving bin 38 of the slat dispensing station 30 such that the slats 24 will fit loosely in the slot 44 of the receiving bin with little excess play. By loosening the adjustment clamps 108 of the base frame 106, the distance between first and second beams 90,92 of the slat conveying mechanism 36 is adjusted such that a slat 24 can pass between the drive wheels 88 and the idler wheels 86 with a slight press fit to ensure that the wheels will be in frictional engagement with the slats. Allowing both the first and second beams 90,92 of the slat conveying mechanism 36 to be adjusted, allows the fastener slot 74 in the lower base plate 70 of the clamping station 34 to remain positioned centrally between the drive wheels 88 and the idler wheels 86, as is desirable. Once in place, the adjustment clamps 108 are tightened to secure the first and second beams 90,92 in place. The bar members 60 of the block holder member 56 of the block dispensing station 32 can also be adjusted if needed via the adjustment knobs 61 such that blocks 26 of a particular size will fit loosely in the slot 44 of the block holder member 56 with little excess play.

In operation, a plurality of slats 24 are either manually or automatically loaded into the receiving bin 38 of the block dispensing station 32 in a stacked manner. The roller pin 52 of the block dispensing station 32 can assist a person in inserting the first few slats 24 longitudinally into the receiving bin 38. In a similar manner a plurality of blocks 26 are either manually or automatically loaded into the slot 62 of the block holder member 56 of the block dispensing station 32.

When activated, the control unit of the pallet assembly device 28 of the preferred embodiment begins the process of automatically assembling a stinger 22 by activating the cylinder 76 of the block conveyor mechanism 37. When activated, the piston 76 retracts and causes the tooth member 82 to move along the elongated slot 54 of the horizontal surface 42 in a direction toward the clamping station 34. As this occurs, the tooth member 82 engages a longitudinal end of the lower most slat 24 of the stack of slats positioned in the slot 44 of the receiving bin 38 and forces the slat toward the clamping station 34 along the horizontal surface of the slat dispensing station 30. The size of the opening 48 beneath the end wall 46 of the receiving bin 38 prevents the remaining slats from moving with the lower most slat and retains such slats in the receiving bin.

The control unit also triggers the electric motor 98 of the slat conveying mechanism 36 to cause the drive wheels 88 to begin rotating via the drive belts 96. This preferably occurs simultaneously with activation of the cylinder 76, or shortly thereafter. As the slat 24 being moved by the cylinder 76 progresses toward the clamping station 34, it eventually engages between the idler wheels 86 and the driving wheels 88 of the slat conveying mechanism 36. When this occurs, movement of the slat 24 is taken over by the rotation of the drive wheels 88 and the drive wheels 88 then continue to move the slat along the lower base plate 70 of the clamping station 34. As the slat 24 continues to move, it eventually triggers the slat position sensor 80 that, in response, sends a signal to the control unit.

Having received the signal that a slat 24 has reached the position of the slat position sensor 80, it should be understood and appreciated that the control unit can be configured to move the slat to any number of specific positions along the lower base plate 70 of the clamping station 34 by controlling the starting and stopping of the driving wheels 88 via control of the electric motor 98, with additional sensors. In other words, the control unit sees that the first block has been attached and has moved to the next switch that can be positioned back and forth to determine the placement of the second block. Another switch is tripped to determine the placement of the third block which is also adjustable. In this manner, the slat 24 is moved to and stopped at a first position, as shown in FIG. 7, wherein the longitudinal end of the slat farthest from the slat dispensing station 30 is positioned directly beneath the upper horizontal plate 68 of the clamping station 34.

With the slat 24 stopped in the first position, the control unit triggers the cylinder 100 of the block conveying mechanism 37 to cause the pushing ram 104 to move toward the clamping station 34. As this occurs, the pushing ram 104 engages the lower most block 26 stored in the block holder member 56 and forces it through the opening 64 of the block holder member toward the slat 24. The block holder surface 58 of the block dispensing station 32 is positioned above the lower base plate 70 of the clamping station 34 by a distance slightly greater than the thickness of the slat 24. Thus, as the block 26 is translated via the pushing ram 104 of the block conveying system 37, the block slides over the slat 24 and drops thereon. The pushing ram 104 continues to push the block 26 until it engages against the side plate 72 of the clamping station 34. The side plate 72 is positioned such that it is aligned with the perimeters of the idler wheels 86 and therefore acts as a guide rail that is flush with an edge of the slat. Thus, as the pushing ram 104 biases the block 26 against the side plate 72 of the clamping station 34, at least one side of the block is automatically aligned with a widthwise edge of the slat 24. Simultaneously, the control unit activates the cylinder 66 of the clamping station 34 to force the upper horizontal plate 68 downward against the block 26.

Figure 7:
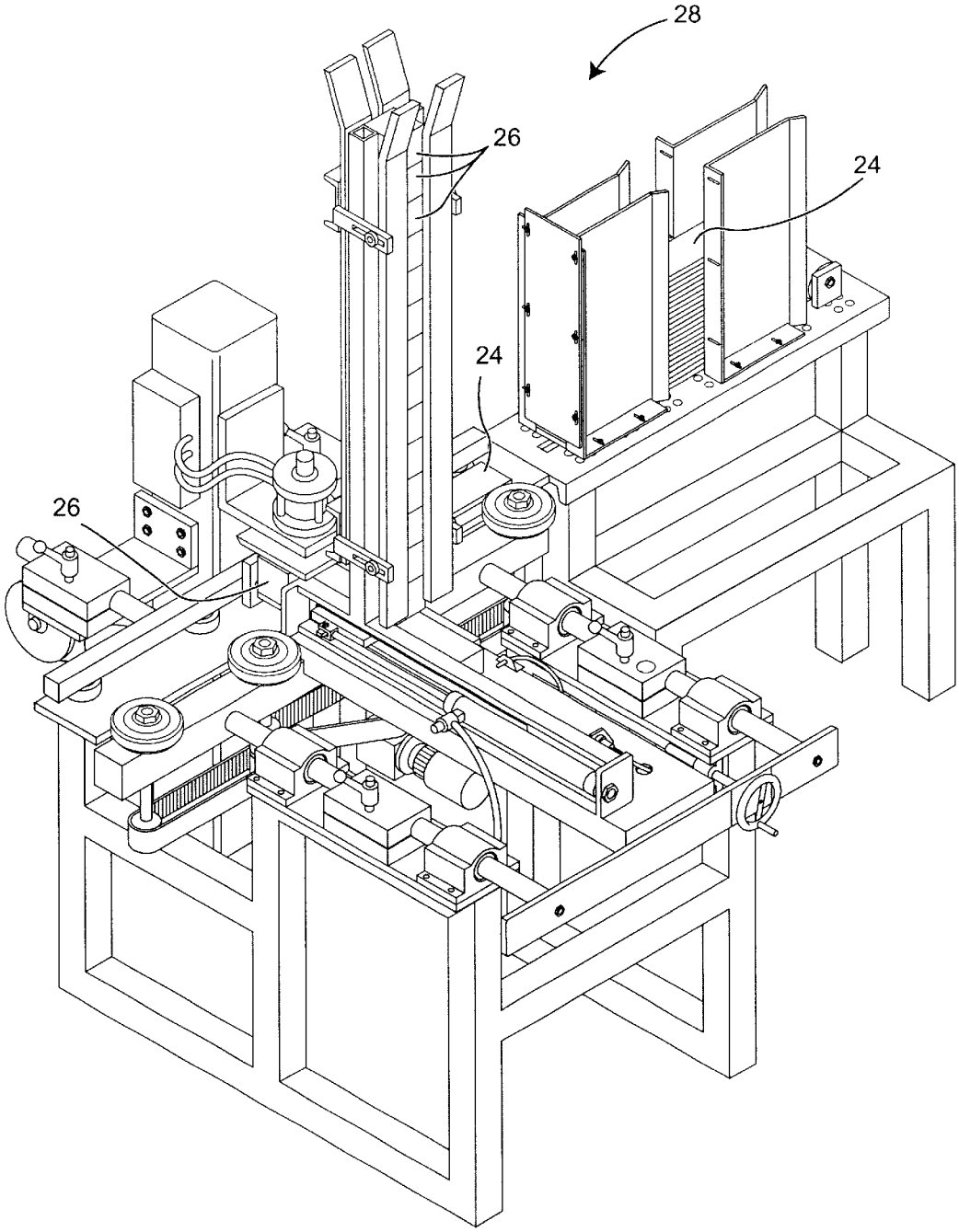
FIG. 7 is a view similar to FIG. 2, showing a slat in a first position with a block clamped thereto.

With the upper horizontal plate 68 of the clamping station 34 biasing the block 26 downward against the slat 24 and the pushing ram 104 biasing the block horizontally against the side plate 72 of the clamping station 34 as shown in FIG. 7, the control unit activates the automatic fastening device to force a fastener upwardly through the fastener slot 74 of the lower base plate 70 of the clamping station and into the slat and block. The fastener secures the block 26 and slat 24 together and, thereafter, the control unit then activates the cylinders 66,100 to unclamp the block 26 and slat 24 by raising the upper horizontal plate 68 of the clamping station 34 and moving the pushing ram 104 away from the side plate 72. As the pushing ram 104 returns to its original position, it passes out from under the block holder member 56 and allows the remaining blocks being held by the block holder member to drop down onto the block holder surface 58.

Figure 8:
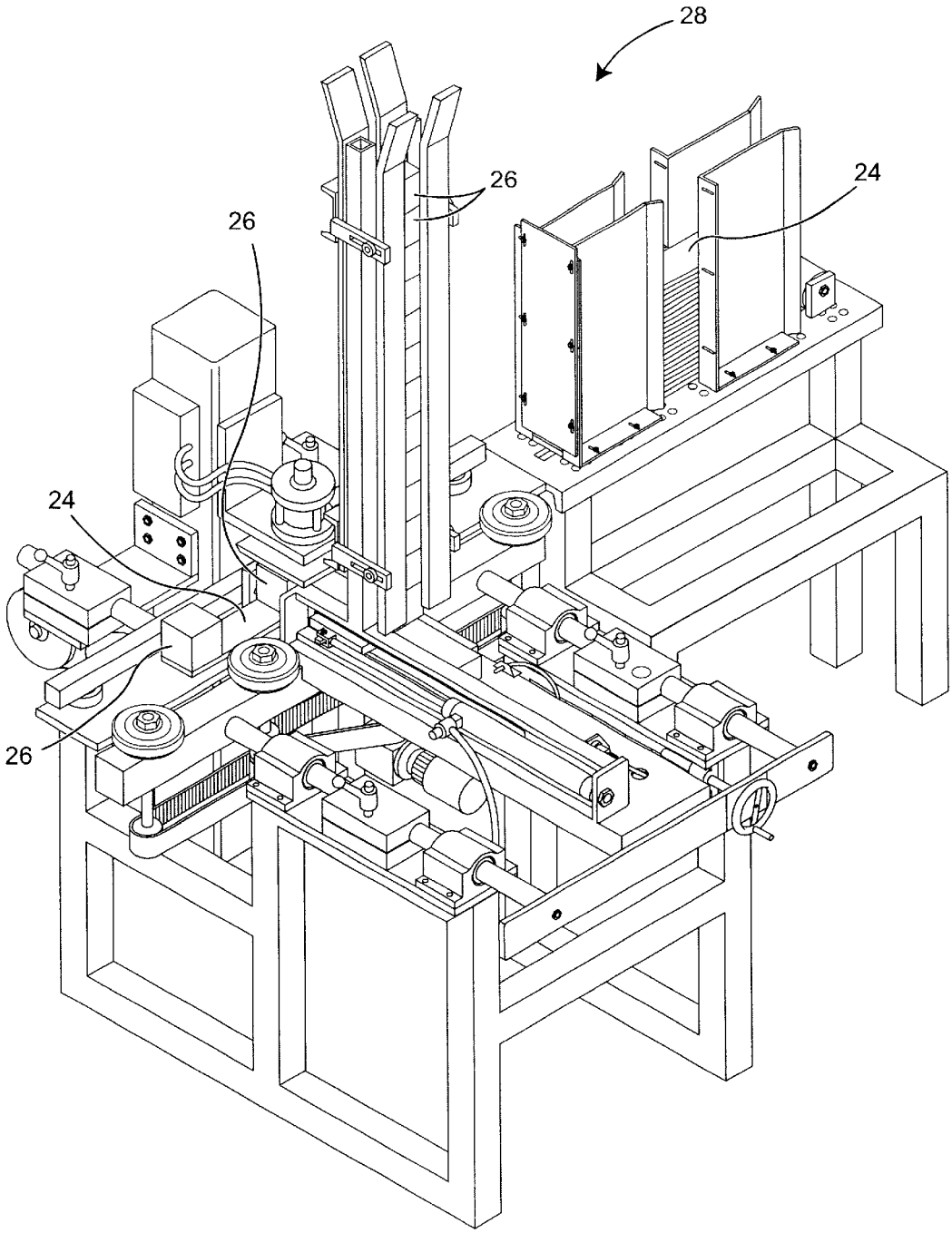
FIG. 8 is a view similar to FIG. 2, showing the slat of FIG. 7 in a second position with the first block attached thereto and with a second block clamped thereto.
Figure 9:
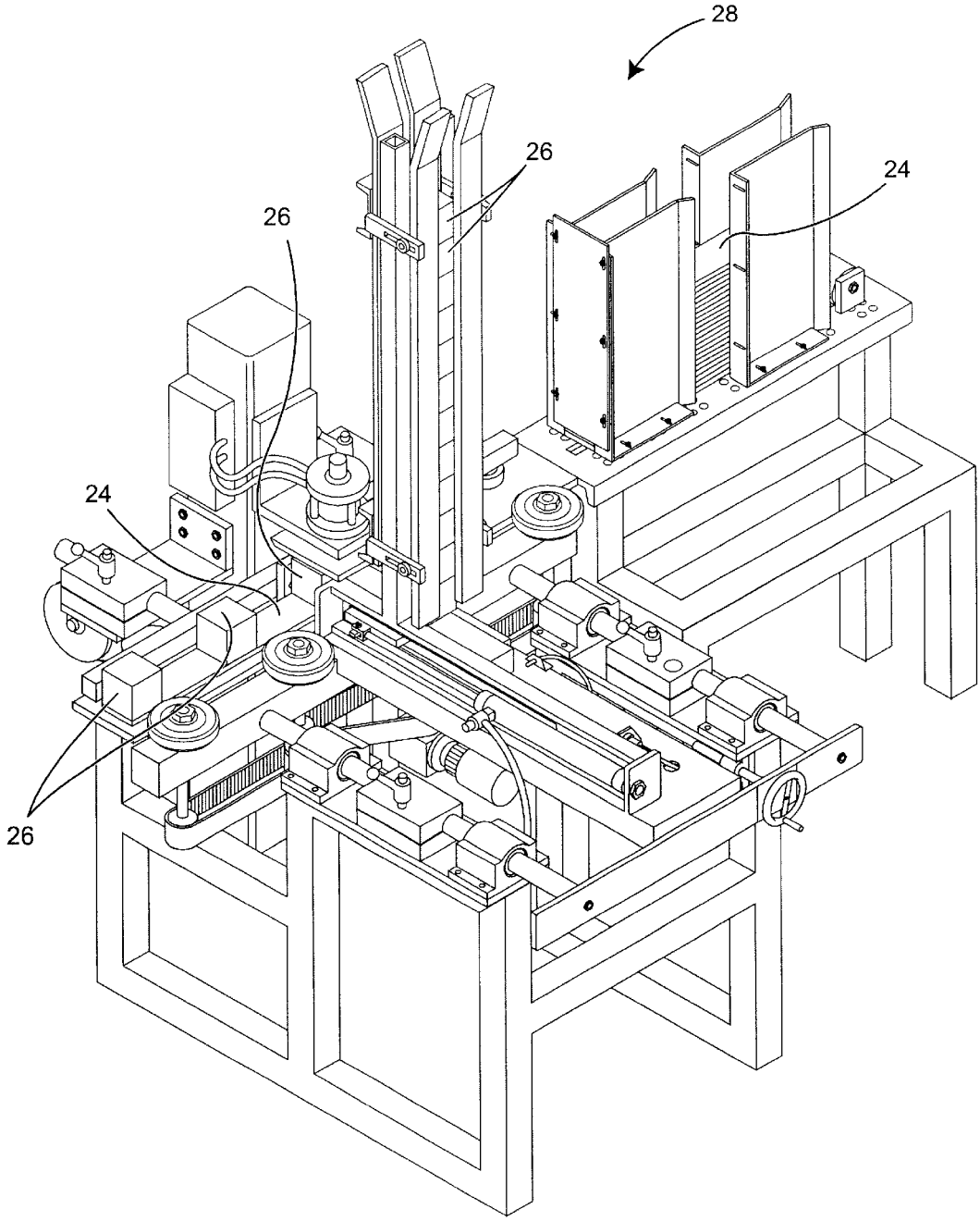
FIG. 9 is a view similar to FIG. 2, showing the slat of FIGS. 7 and 8 in a third position with the first and second blocks attached thereto and with a third block clamped thereto.

With the first block 26 attached to the slat 24, the control unit then activates the electric motor 98 to advance and stop the slat 24 at a second position where the longitudinal center of the slat is beneath the upper horizontal plate 68 of the clamping station 34. With the slat 24 stopped in the second position, the procedures described above are automatically repeated to secure a second block 26 to the slat, as shown in FIG. 8. Afterwards, the control unit then again activates the electric motor 98 to advance and stop the slat 24 at a third position where the longitudinal end of the slat nearest the slat dispensing station 30 is beneath the upper horizontal plate 68 of the clamping station 34. Once more, the procedures described above are automatically repeated to secure a third block 26 to the slat 24, as shown in FIG. 9.

With the above-described steps performed, the formation of a stringer 22 is complete and the control unit once again activates the electric motor 98 to advance the stringer off of the lower base plate 70 of the clamping station 34. The control unit also simultaneously activates the cylinder 76 of the slat conveying system to return the tooth member 82 to its original position so that the entire procedure can be repeated automatically to form additional stringers 22.

Form the above-description, it should be clear that an operator of the pallet assembly device 28 of the preferred embodiment needs only to stack additional slats 24 in the receiving bin 38 of the slat dispensing station 30 and additional blocks 26 in the block holder member 56 block dispensing station 32 to continuously produce block-style pallet stringers 22. Furthermore, it should be appreciated that pallet assembly device 28 of the preferred embodiment has substantially fewer moving parts than most prior art pallet assembly devices, thereby reducing the likelihood of breakage.

The preferred embodiment of the invention has been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. For example, is should be appreciated that, although the pallet assembly device of the preferred embodiment is specifically configured for use assembling the stringers of block-style pallets, the invention could also be utilized to assemble other portions and other types of pallets. Thus, the breadth and scope of the present invention should not be limited by the above-described exemplary embodiment, but should be defined only in accordance with the following claims appended hereto and their equivalents.

What is claimed is:

1. A method of assembling a pallet comprising:

providing an automated pallet assembly apparatus having an assembly path, a slat dispensing station, and a block dispensing station, the assembly path operatively connecting the slat dispensing station to the block dispensing station;

providing a plurality of slats to the slat dispensing station of the assembly apparatus, each of the plurality of slats having a longitudinal length, a lateral width, and a transverse thickness, the longitudinal length of each of the plurality of slats defining first and second longitudinal ends of the respective slat;

providing a plurality of blocks to the block dispensing station of the assembly apparatus;

utilizing the assembly apparatus to automatically longitudinally move a first one of the plurality of slats along the assembly path from the slat dispensing station toward the block dispensing station and to automatically stop the movement of the first slat at a first position along the assembly path, the first position being such that the first longitudinal end of the first slat is positioned adjacent the block dispensing station along the assembly path;

automatically biasing a first block of the plurality of blocks into engagement with the first slat via the assembly apparatus, the engagement of the first block with the first slat occurring with the first slat stopped in the first position such that the first block engages the first slat adjacent the first longitudinal end of the first slat;

automatically fastening the first slat to the first block while the first slat and the first block are being biased into engagement with each other;

utilizing the assembly apparatus to automatically longitudinally move the first slat from the first position and to automatically stop the movement of the first slat at a second position along the assembly path, the second position being further along the assembly path from the slat dispensing station than the first position;

automatically biasing a second block of the plurality of blocks into engagement with the first slat via the assembly apparatus, the engagement of the second block with the first slat occurring with the first slat in the second position such that the second block engages the first slat intermediate the first longitudinal end and the second longitudinal end of the first slat where the second block is spaced apart from the first block; and automatically fastening the first slat to the second block while the first slat and the second block are being biased into engagement with each other.

2. A method in accordance with claim 1, further comprising the steps of: utilizing the assembly apparatus to automatically longitudinally move the first slat from the second position and to automatically stop the movement of the first slat at a third position along the assembly path, the third position being further along the assembly path from the slat dispensing station than the second position; and automatically biasing a third block of the plurality of blocks into engagement with the first slat via the assembly apparatus, the engagement of the third block with the first slat occurring with the first slat in the third position such that the third block engages the first slat adjacent the second longitudinal end of the first slat where the third block is spaced apart from the second block; and automatically fastening the first slat to the third block while the first slat and the third block are being biased into engagement with each other.

3. A method in accordance with claim 1, wherein the steps of utilizing the assembly apparatus to automatically longitudinally move the first slat from the first position and to automatically stop the movement of the first slat at a second position along the assembly path and utilizing the assembly apparatus to automatically longitudinally move the first slat from the second position and to automatically stop the movement of the first slat at a third position along the assembly path occurs without the use of a carriage that travels with the first slat along the assembly path.

4. A method in accordance with claim 1, wherein the width of the first slat is oriented generally horizontally when the first slat is in the first, second, and third positions and wherein the first, second, and third blocks are each positioned above the first slat when being biased into engagement with the first slat.

5. A method in accordance with claim 4, wherein the first, second, and third blocks are each biased downwardly into engagement with the first slat and wherein each of the first, second, and third blocks is fastened to the first slat from beneath the first slat via a fastener that passes through the thickness of the first slat and that extends at least partially upward through the respective block.

6. A method in accordance with claim 5, wherein the step of providing the assembly apparatus further comprises providing the assembly apparatus such that the assembly apparatus has a vertically oriented guide surface and wherein the method further comprises:

automatically biasing the first block horizontally into engagement with the guide surface of the assembly apparatus via the assembly apparatus when the first slat is stopped in the first position;

automatically biasing the second block horizontally into engagement with the guide surface of the assembly apparatus via the assembly apparatus when the first slat is stopped in the second position; and automatically biasing the third block horizontally into engagement with the guide surface of the assembly apparatus via the assembly apparatus when the first slat is stopped in the third position.

7. A method in accordance with claim 4, wherein the step of providing the assembly apparatus further comprises providing the assembly apparatus such that the assembly apparatus has at least two wheels that are mounted to the assembly apparatus for rotation about separate axes and wherein the steps of utilizing the assembly apparatus to automatically longitudinally move the first slat from the first position and to automatically stop the movement of the first slat at a second position along the assembly path and utilizing the assembly apparatus to automatically longitudinally move the first slat from the second position and to automatically stop the movement of the first slat at a third position along the assembly path occurs by engaging the width of the first slat between the two wheels of the of the assembly apparatus in a manner such that each of the two wheels exerts a force on the first slat and automatically rotationally driving and rotationally stopping at least one of the two wheels to cause the first slat to move and stop respectively along the assembly path.

8. A method in accordance with claim 7, wherein the step of providing the assembly apparatus further comprises providing the assembly apparatus such that the assembly apparatus has a sensor, the method further comprising automatically identifying that the first longitudinal end of the first slat is at a particular position along the assembly path via the sensor, the rotational driving and rotational stopping of the at least one of the two wheels of the assembly apparatus being correlated to rotations of the at least one of the two wheels subsequent to the identification of the first longitudinal end of the first slat being at the particular position along the assembly path via the sensor.

9. A method in accordance with claim 7, wherein the step of providing the assembly apparatus further comprises providing the assembly apparatus such that the slat dispensing station of the assembly apparatus comprises a cylinder, the step of utilizing the assembly apparatus to automatically longitudinally move the first slat along the assembly path from the slat dispensing station toward the block dispensing station further comprising initially longitudinally moving the first slat along the assembly path from the slat dispensing station by automatically actuating the cylinder in a manner such that the cylinder exerts a force to the second longitudinal end of the first slat that is directed toward the first longitudinal end of the first slat, the force causing the first slat to move along the assembly path until the first slat engages the two wheels of the assembly apparatus and the at least one wheel is able to cause the first slat to move along the assembly path.

10. A method in accordance with claim 1, wherein each of the steps of automatically fastening the first slat to the first block, automatically fastening the first slat to the second block, and automatically fastening the first slat to the third block further comprises cutting a length of wire from a spool of wire via the assembly apparatus, forming a staple from the length of wire, and fastening the first slat to the respective block by passing the staple through the thickness of the first slat and at least partially through the respective block.

11. A pallet assembly device comprising:

a slat dispensing station, the slat dispensing station being configured and adapted to hold a plurality of pallet slats stacked vertically one above another;

a block dispensing station, the block dispensing station being configured and adapted to hold a plurality of pallet blocks stacked vertically one above another;

a clamping station configured and adapted to bias a block into engagement with a slat;

a slat conveying mechanism operatively connecting the slat dispensing station to the clamping station, the slat conveying mechanism being configured and adapted to repetitively engage and separate a lower most slat of such a plurality of slats positioned in the slat dispensing station and to transfer such a slat to the clamping station, the slat conveying mechanism being further configured and adapted to position such a slat at first, second, and third distinct stopped positions relative to the clamping station;

a block conveying mechanism, the block conveying mechanism being configured and adapted to repetitively engage and separate a lower most block of such a plurality of blocks positioned in the block dispensing station and to transfer such a block to the clamping station, the block conveying mechanism being further configured and adapted to position such a block above and in engagement with a slat when such a slat has been transferred to the clamping station via the slat conveying mechanism and has been stopped in any one of the first, second, and third distinct stopped positions; and an automatic fastening device configured and adapted to force a fastener through a slat and into a block when such a slat has been transferred to the clamping station via the slat conveying mechanism and has been stopped in any one of the first, second, and third distinct stopped positions and when a block has been positioned above and in engagement with such a slat via the slat conveying mechanism and is being bias into engagement with such a slat via the clamping station.

12. A pallet assembly device in accordance with claim 11, wherein the slat conveying mechanism comprises a plurality of wheels that are mounted to the assembly device for rotation about separate axes, the wheels being positioned to simultaneously engage opposite sides of a slat when such a slat is being transferred by the slat conveying mechanism, the slat conveying mechanism also comprising a drive motor that is operatively connected to at least one of the plurality of wheels in a manner allowing the drive motor to rotationally drive and rotationally stop at least one of the plurality of wheels.

13. A pallet assembly device in accordance with claim 12, further comprising a sensor positioned where the sensor will detect that a slat is at a particular position when such a slat is being transferred by the slat conveying mechanism, the sensor being operatively connected to the drive motor, the motor being configured and adapted to drive and rotationally stop the at least one of the plurality of wheels in response to the sensor detecting such a slat being at the particular location in a manner to position such a slat at the first, the second, and the third distinct stopped positions relative to the clamping station when such a slat is being transferred by the slat conveying mechanism.

14. A pallet assembly device in accordance with claim 13, wherein the plurality of wheels define first and second parallel rows of wheels, the drive motor being operatively connected to each of the wheels of the first row of wheels via at least one endless belt.

15. A pallet assembly device in accordance with claim 11, wherein the automatic fastening device comprises an automatic stapler that is positioned to force a staple through a slat and into a block when such a slat has been transferred to the clamping station.

16. A pallet assembly device comprising:

a component dispensing station, the component dispensing station being configured and adapted to hold a plurality of pallet components;

a clamping station configured and adapted to bias pallet components together; and a component conveying mechanism operatively connecting the component dispensing station to the clamping station, the component conveying mechanism comprising a plurality of wheels that are mounted to the assembly device for rotation about separate axes, the wheels being positioned to simultaneously engage opposite sides of a pallet component when such a component is being transferred by the component conveying mechanism to the clamping station, the component conveying mechanism also comprises a drive motor that is operatively connected to at least one of the plurality of wheels in a manner allowing the drive motor to rotationally drive and rotationally stop at least one of the plurality of wheels.

17. A pallet assembly device in accordance with claim 16, further comprising a sensor positioned where the sensor will detect that a pallet component is at a particular position when such a pallet component is being transferred by the component conveying mechanism, the sensor being operatively connected to the drive motor, the motor being configured and adapted to drive and rotationally stop the at least one of the plurality of wheels in response to the sensor detecting such a pallet component being at the particular location in a manner to position such a pallet component at alternative positions relative to the clamping station when such a pallet component is being transferred by the component conveying mechanism.

18. A pallet assembly device in accordance with claim 16, wherein the plurality of wheels define first and second parallel rows of wheels, the drive motor being operatively connected to each of the wheels of the first row of wheels via at least one endless belt.

19. A pallet assembly device in accordance with claim 16, further comprising an automatic fastening device positioned to secure pallet components together when such pallet components are being biased together via the clamping station.

20. A pallet assembly device in accordance with claim 19, wherein the clamping station is further configured and adapted to bias components together when such components are positioned above and below each other.

* * * * *